US005887846A

United States Patent [19]

Hupp

[11] Patent Number: 5,887,846

[45] Date of Patent: Mar. 30, 1999

[54] MOLD DEVICE FOR FORMING CONCRETE PATHWAYS

[76] Inventor: Jack T. Hupp, 1010 Lively Ct., Richmond, Tex. 77469

[21] Appl. No.: 815,626

[22] Filed: Mar. 13, 1997

Related U.S. Application Data

[63] Continuation of Ser. No. 900,062, Jun. 16, 1992, abandoned.

[51] Int. Cl.[6] ..... E01C 19/50

[52] U.S. Cl. ..... 249/2; 249/129; 404/41; 425/458

[58] Field of Search ..... 425/87, 458; 249/2, 249/3, 4, 6, 129, 131, 132, 188, 189; 404/87, 88, 89, 93, 105, 41, 42; D15/136

[56] References Cited

U.S. PATENT DOCUMENTS

| | | |
|---|---|---|
| D. 5,840 | 5/1872 | Ingalls . |
| D. 204,803 | 5/1966 | Leeth . |
| D. 257,824 | 1/1981 | Puccini et al. . |
| D. 257,825 | 1/1981 | Puccini et al. . |
| D. 272,037 | 1/1984 | Puccini . |
| D. 281,505 | 11/1985 | Larsen et al. . |
| D. 342,528 | 12/1993 | Hupp ..... D15/136 |

(List continued on next page.)

FOREIGN PATENT DOCUMENTS

| | | |
|---|---|---|
| 550233 | 12/1927 | Canada . |
| 18249 | 7/1951 | Canada . |
| 491472 | 3/1952 | Canada . |
| 7012995 | 4/1987 | Germany . |
| WO9110546 | 7/1991 | WIPO . |

OTHER PUBLICATIONS

Boden Beläge — 3 sheets literature — undated.
1 sheet of drawing No. 7122626 — Jun. 9, 1971.
Color Tile advertisement, Royal Rock ceramic tile, Houston Post, Jan. 14, 1990.
Photocopy (front and back) of Color Tile Royal Rock ceramic tile.
Creterprint — Pattern Imprinted Concrete — 9 sheets literature, undated.
Manuale Per La Costruzione Di, Pavimenti Di Pietra — 5 sheets literature, 1977.
Uni–Group U.S.A. Manufacturers of Uni Paving Stones The Original. The Best — 4 sheets of literature, undated.
Brickform Texture Mats — 1 sheet, undated.
Brickform Patterns — 1 sheet, undated.
Brickform Tools — Texture Mats — 4 sheets, commercial literature — undated.
Leadership, A Reputation for Excellence, Innovation & Experience, 4 sheets literature — undated.
The Complete Book of Outdoor Masonry, Tab Books — 3 sheets of literature — Sep. 4, 1979.
Lasting Impressions in Concrete, Inc. — 6 sheets of literature — undated.
Backyard Brickwork — 3 sheets of literature — 1989.
Basic Masonry Illustrated, Lane Publishing Co. — 4 sheets literature — undated.
Handyman's Guide to Concrete and Masonry — 9 sheets literature — 1978.
Handy Man's Concrete and Masonry Handbook, The Do–It–Yourself Series — 3 sheets literature — 1969.

*Primary Examiner*—Patrick Ryan
*Assistant Examiner*—Joseph Leyson
*Attorney, Agent, or Firm*—Nick A. Nichols, Jr.

[57] ABSTRACT

In an apparatus for forming concrete pathways, a mold includes a plurality of openings for receiving concrete therein. The mold openings define separate and distinct concrete cavities. Concrete pathways, are formed by placing the mold of the invention on a surface for receiving the concrete in the concrete cavities. Upon removal of the mold, the concrete segments retain the shape of the mold cavities and are slightly separated from each other. The procedure is repeated to form a pathway of a desired length and configuration.

3 Claims, 2 Drawing Sheets

U.S. PATENT DOCUMENTS

| | | |
|---|---|---|
| 1,600,787 | 9/1926 | Ardit . |
| 1,953,657 | 8/1934 | Pierce . |
| 2,050,299 | 8/1936 | Evers . |
| 2,606,428 | 8/1952 | Oldfather . |
| 2,893,098 | 7/1959 | Tilley . |
| 3,600,773 | 8/1971 | Davis . |
| 4,078,760 | 3/1978 | Mullins . |
| 4,105,354 | 8/1978 | Bowman . |
| 4,131,406 | 12/1978 | Fresquez . |
| 4,135,840 | 1/1979 | Puccini et al. . |
| 4,231,677 | 11/1980 | Roming . |
| 4,287,141 | 9/1981 | Russell . |
| 4,313,689 | 2/1982 | Reinschütz . |
| 4,354,773 | 10/1982 | Noack . |
| 4,407,480 | 10/1983 | Trimmer et al. . |
| 4,452,419 | 6/1984 | Saleeba . |
| 4,609,303 | 9/1986 | Schumaker . |
| 4,627,764 | 12/1986 | Scheiwiller . |
| 4,773,790 | 9/1988 | Hagenah . |
| 4,828,426 | 5/1989 | Hendricks et al. . |
| 4,838,728 | 6/1989 | McKeever . |
| 4,921,372 | 5/1990 | Hybertson . |
| 5,051,023 | 9/1991 | Yoshida et al. . |
| 5,211,895 | 5/1993 | Jacklich, Sr. . |

MOLD DEVICE FOR FORMING CONCRETE PATHWAYS

This is a continuation application of U.S. patent application Ser. No. 07/900,062 filed Jun. 16, 1992, now abandoned.

BACKGROUND OF THE DISCLOSURE

The present invention is directed to an apparatus for forming concrete pathways, particularly, a plastic mold for configuring geometric designs for sidewalks, patios, gardens and the like.

The formation of sidewalks or concrete pathways typically requires excavation of a pathway, the assembly of wooden or metal forms which normally are required to restrain the sides of the concrete after pouring and then disassembly of the wooden or metal forms once the concrete has cured. Thus, conventional concrete forming methods are costly both in terms of labor and materials.

Concrete forming devices known in the prior art employ a mold to form the concrete to a desired shape. As the concrete begins to cure, the mold is removed and the next concrete member or section is formed. The use of such mold devices allows concrete sections of relatively uniform shape to be continuously formed having the cross-sectional configuration of the mold. Such prior art devices include U.S. Pat. No. 2,893,098 to Tilley which discloses a mold for applying simulated masonry to walls and the exterior surfaces of buildings. U.S. Pat. No. 3,600,773 to Davis discloses a concrete forming device of rather complex construction. A mold component of the device includes movable lower side edge portions which are resiliently biased downwardly to accommodate surface irregularities for confining the concrete in the mold.

U.S. Pat. No. 4,287,141 to Russell discloses an apparatus for forming embankments of trapezoidal shape. The trapezoidal-shaped shield apparatus is opened at the top and bottom, and rearwardly. Concrete is introduced into the top of the shield for forming each segment of the embankment.

U.S. Pat. No. 4,354,773 to Noack discloses a simulated interlocking stone paving block. The concrete paving blocks are formed with a mold. U.S. Pat. No. 4,407,480 discloses a textured brick form. U.S. Pat. No. 4,609,303 to Schumaker discloses an apparatus for forming concrete pathways. The apparatus continuously moves along the path as concrete is poured through a hopper extending upwardly from the top of the apparatus.

As noted in U.S. Pat. No. 4,609,303 a critical problem with prior art slip-forming devices used in the construction of concrete pathways is that the concrete that is discharged from such devices tends to crack or fracture. The tendency to crack during setting is particularly acute in applications requiring a concrete aggregate that contains an amount of water sufficient to insure the formation of a smooth surface as the concrete member is being discharged from the form. Frequently, an entire concrete section must be removed and repoured due to the cracking and/or fragmentation following setting.

The concrete forming apparatus of the present invention overcomes the disadvantages of the prior art devices by providing a mold to rapidly (usually within two minutes) form an entire section of concrete comprising a plurality of discrete concrete segments substantially smaller in dimension than formed by prior art devices thereby reducing the likelihood of cracks or fractures. The mold is configured such that two sides of the apparatus will always interlink with a previously formed section to provide for an apparent seamless unbroken association between the new section and the previously formed section. The discrete concrete segments may be left separated from and independent of each other with earth or some other material utilized as a stabilizer or the segments can be bound together as a unit by the mold and each adjacent unit can be bound to a previously formed unit, if accomplished before the concrete sets up. The binding process is accomplished by (1) removing the form immediately after filing each cavity with concrete, (2) distributing a small amount of concrete between each segment, and (3) replacing the mold and applying downward pressure to the mold thereby distributing the added concrete evenly throughout the mold matrix and binding each segment to an adjacent segment at its lower extremity. Binding of each segment can also be accomplished by evenly spreading a layer of concrete on the surface of the ground prior to placing the mold and filling its cavities in the conventional manner. This allows for a concrete underlayment and attachment of the discrete segments. The present invention also overcomes the disadvantages of prior art by allowing partial segments of the mold to be utilized in the forming of curves, flares, and circles that interconnect in an apparent seamless manner thereby allowing for maximum flexibility in the design of pathways and other ground covering.

SUMMARY OF THE INVENTION

The present invention is directed to a mold for forming concrete pathways. The mold comprises a plurality of openings for receiving concrete therein. The mold openings define separate and distinct mold cavities. The mold of the invention is placed on a substantially flat surface for receiving concrete in the mold cavities. Upon removal of the mold of the invention the concrete segments retain the shape of the mold cavities and are slightly separated from each other thereby forming a concrete pathway section of discrete concrete segments.

BRIEF DESCRIPTION OF THE DRAWINGS

So that the manner in which the above recited features, advantages and objects of the present invention maybe attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
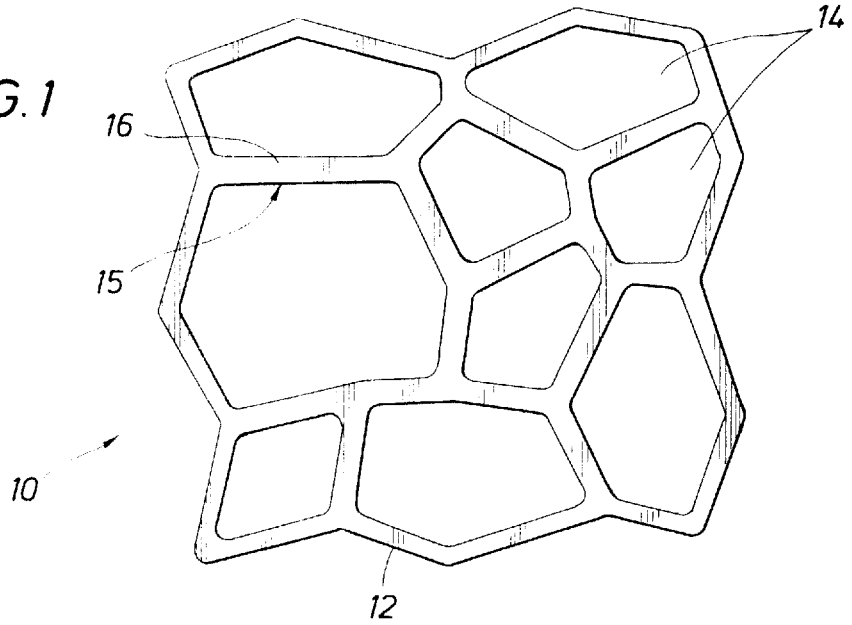
FIG. 1 is a top plan view of the mold of the invention.
Figure 3:
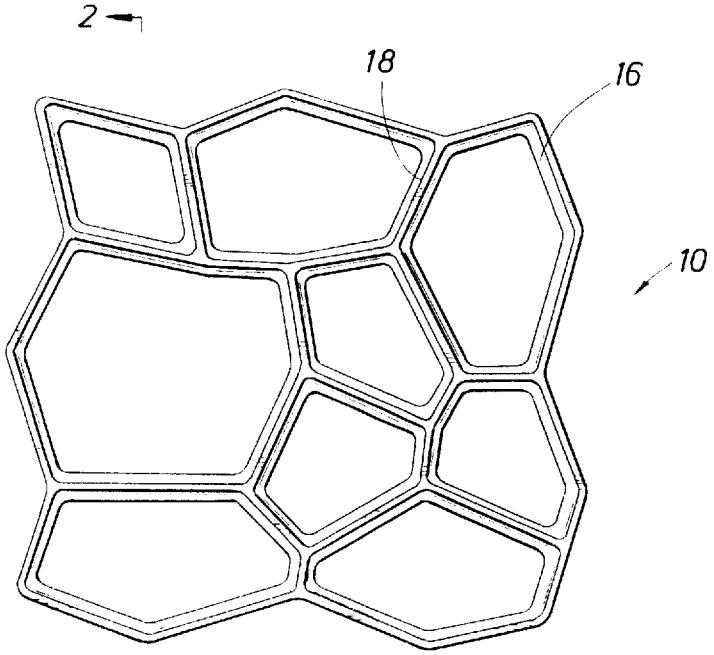
FIG. 3 is a bottom, plan view of the mold of the invention.

Referring first to FIG. 1, the concrete mold of the present invention is generally identified by the reference numeral 10. The mold 10 comprises a plastic body 12 which is substantially planar, and in the embodiment shown in FIGS.

Figure 5:
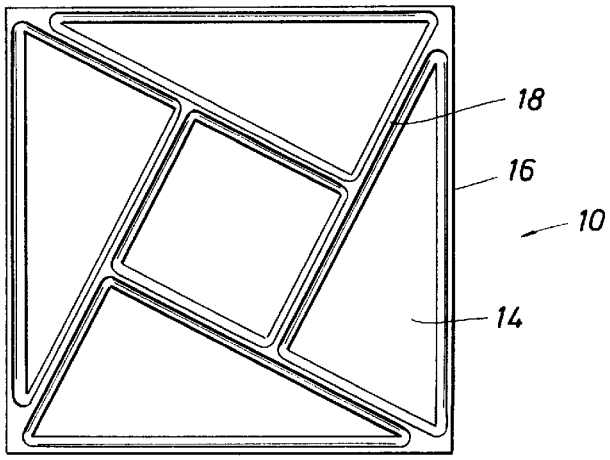
FIG. 5 is a bottom, view of an alternate embodiment of the mold of the invention.

1–4 defines an irregular configuration. It is understood however that the mold 10 may be formed in any desired configuration. In FIG. 5, for example, the mold 10 embodies a straight-line profile; the sidewalls and interconnecting members join to form precise triangles and squares. The outside dimensions of the mold 10 are approximately 2 feet by 2 feet and the height of the mold 10 is approximately 1½ to 2 inches.

Figure 4:
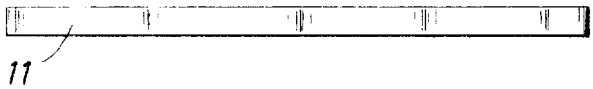
FIG. 4 is an end view of the mold of the invention.

Referring now to FIG. 1 and FIG. 4 the perimeter sidewalls 11 of the mold 10 circumscribe a plurality of irregular shaped openings 14. The openings 14 are formed by a plurality of interconnecting members 15 which are approximately 1½ inches in width. The interconnecting members 15 include substantially horizontal, upper planar surfaces 16 which define the upper exposed face or surface of the mold 10.

Figure 2:
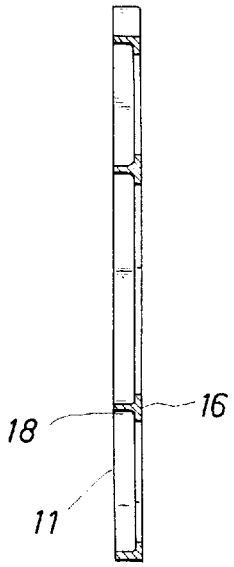
FIG. 2 is a section view taken along line 2—2 of FIG. 3.

Depending downwardly from the interconnected planar surfaces 16 are a plurality of interconnecting ribs 18 which enclose and define the depth of the mold cavities 14 below the exposed upper surface of the mold 10. The ribs 18 are relatively narrow at the lower ground engaging end thereof and curve outwardly and merge with the bottom of the planar surface 16 of the interconnecting members 15. The planar surfaces 16, and ribs 18 are substantially T-shaped in cross-section as shown in FIG. 2. The T-shaped configuration of the planar surfaces 16, and ribs 18 permits the mold 10 to form discrete concrete segments 20 which are curved about the perimeter thereof so that the tendency of the concrete segments to crack or fracture when the mold 10 is removed is virtually eliminated.

Figure 6:
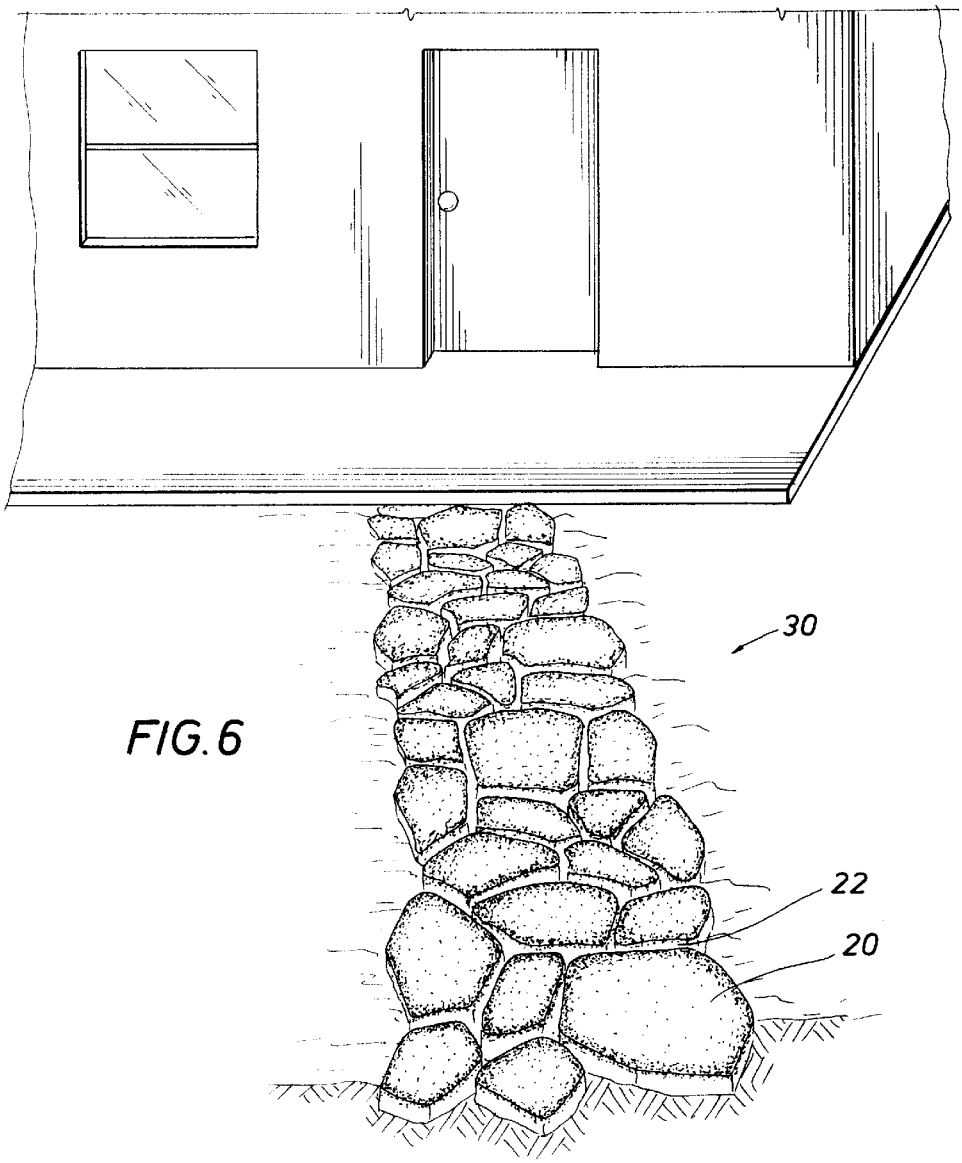
FIG. 6 is an illustration of concrete segments formed with the mold of the invention.

The perimeter sidewalls 11 of the mold 10 defined by the sidewalls 11 present a profile which is the reverse of the opposite side of the mold 10 so that each section of a pathway 30, as best shown in FIG. 6, formed by the mold 10 will interlink with a previously formed concrete section. By alternately rotating the mold 10 one quarter turn to interlock with a previously formed concrete section, a more random pattern of discrete concrete segments 20 is achieved.

Use of the mold 10 to form a concrete pathway is relatively simple. The mold 10 is placed directly on any relatively flat surface. It will automatically configure the concrete to the existing base. For professional results, removal of about one inch of top soil and leveling of the mold 10 before filling the cavities 14 with concrete is recommended. The removed top soil may be utilized later to fill in the open spaces 22 on the sides and between the concrete segments 20 after the concrete pathway 30 has been completed. It is recommended that one gallon of water be mixed with one 80-pound bag of pre-mix cement. The cement should be thoroughly mixed until a plastic-like consistency is reached. If additional water is required, one cup at a time is added until the correct consistency is attained. Thereafter, each mold cavity 14 is filled with the cement mixture and is leveled with the upper surface 16 of the mold 10. The surface of the concrete segments 20 may be smoothed with a trowel if desired. After removing the mold 10, the edges of the concrete segments 20 may be smoothed with the trowel until a satisfactory appearance is achieved.

The mold 10 is configured such that two sides thereof will always interlink with a previously formed section to provide for an apparent seamless unbroken association between new section and the previously formed section of the pathway 30. The discrete concrete segments 20 may be left separated from and independent of each other with earth or some other material utilized as a stabilizer or the segments 20 may be bound together as a unit by the mold 10 and each adjacent unit can be bound to a previously formed unit, if accomplished before the concrete sets up.

The binding process is accomplished by removing the mold 10 immediately after filling each cavity 14 with concrete, distributing a small amount of concrete between each segment 20, replacing the mold 10 and applying downward pressure to the mold 10 thereby distributing the added concrete evenly throughout the mold matrix and binding each segment 20 to an adjacent segment 20 at its lower extremity. Binding of each segment 20 can also be accomplished by evenly spreading a layer of concrete on the surface of the ground prior to placing the mold 10 and filling its cavities 14 in the conventional manner. This allows for a concrete underlayment and attachment of the discrete segments 20. Partial segments 20 of the mold 10 may be in an apparent seamless manner thereby allowing for maximum flexibility in the design of pathways and other ground covering.

While the invention herein is described in what is presently considered to be a practical preferred embodiment thereof, it will be apparent that many modifications may be made within the scope of the invention, which scope is to be accorded the broadest interpretation of the appended claims so as to encompass all equivalent methods and apparatus.

While the foregoing is directed to the preferred and illustrated embodiments, the scope is determined by the claims which follow:

What is claimed is:

1. An apparatus for forming a concrete pathway, comprising a unitary body including perimeter sidewalls and a plurality of interconnecting members joined together to form said unitary body, wherein said sidewalls and said interconnecting members circumscribe a plurality of openings defining separate cavities and wherein said sidewalls and said interconnecting members further define a continuous, substantially planar upper surface, said sidewalls and said interconnecting members including rib members depending downwardly from a bottom of said substantially planar upper surface, said rib members terminating at lower ends thereof, and wherein said rib members taper upwardly and outwardly from an intermediate point proximate said lower ends and merge with said bottom of said substantially planar upper surface, and wherein said perimeter sidewalls of said unitary body define an irregular profile and said perimeter sidewalls include opposite sidewall members defining reverse sidewall profiles for interlinking segments of the concrete pathway end to end.

2. The apparatus of claim 1 wherein said openings are irregular in shape.

3. The apparatus of claim 1 wherein said substantially planar upper surface and said rib members define a substantially T-shaped profile in cross-section.

* * * * *